US007251334B1

(12) United States Patent
Sundberg

(10) Patent No.: US 7,251,334 B1
(45) Date of Patent: Jul. 31, 2007

(54) REMOTE SOUND MONITOR AND RECEIVER THEREFOR

(75) Inventor: Brian Sundberg, Chester, NH (US)

(73) Assignee: Summer Infant, Inc., Woonsocket, RI (US)

( * ) Notice: Subject to any disclaimer, the term of this patent is extended or adjusted under 35 U.S.C. 154(b) by 758 days.

(21) Appl. No.: 10/601,823

(22) Filed: Jun. 23, 2003

(51) Int. Cl.
*H04R 29/00* (2006.01)

(52) U.S. Cl. ..... 381/56; 340/539.15; 340/815.46

(58) Field of Classification Search ..... 381/56; 340/573.1, 539.14, 539.15, 815.46
See application file for complete search history.

(56) References Cited

U.S. PATENT DOCUMENTS 6,462,664 B1 * 10/2002 Cuijpers et al. ..... 340/573.1
7,053,779 B2 * 5/2006 Thompson ..... 340/573.1
7,088,259 B2 * 8/2006 Armbruster et al. ... 340/815.46
2003/0231778 A1 * 12/2003 Landa ..... 381/77
2004/0130449 A1 * 7/2004 Hung ..... 340/573.1

* cited by examiner

*Primary Examiner*—Brian T. Pendleton
(74) *Attorney, Agent, or Firm*—IP Strategies

(57) ABSTRACT

A remote sound monitor includes a receiver unit and a transmitter unit. The transmitter unit includes a sound transducer that receives the sound input and converts the sound input to the audio signal, and an audio transmitter that transmits the audio signal. The receiver unit includes an audio receiver that receives a transmitted audio signal having a parameter that corresponds to an amplitude of a remote sound input, and a display that provides a visual indication of the parameter of the audio signal. The display providing the visual indication can flash, strobe, or change colors in response to a change in amplitude of the sound input. The receiver unit can also include an audio speaker with a user-actuated amplification stage to provide remote audio output of the sound input.

66 Claims, 12 Drawing Sheets

REMOTE SOUND MONITOR AND RECEIVER THEREFOR

FIELD OF THE INVENTION

The present invention relates to monitors for supervising sounds emitted at a remote location.

BACKGROUND OF THE INVENTION

There are many situations in which it is advantageous to monitor sounds emitted at a remote location. For example, certain machinery, such as compressors or electrical generators, makes characteristic sounds when operating properly. A change in this characteristic sound is often an early indication of malfunction. This machinery can't always be monitored locally, at least not on a consistent basis. Reproducing the sound at a remote location where the presence of personnel is more constant allows for better supervision of the machinery.

Likewise, the supervision of a sleeping infant can also be performed more reliably when the infant's sounds are monitored remotely. While the infant is sleeping, a parent or babysitter can relax in another room while still monitoring sounds that the infant makes. If the infant wakes up momentarily, the parent is notified and can make sure that the infant gets back to sleep. When the infant is ready to end his nap, or is finished resting quietly and wants to be fed, the parent can hear the infant crying and get him out of his crib.

One advantage to having a remote reproduction of the infant's sounds is that the person supervising the infant can hold a conversation at a normal level, or watch television, without worrying that the sound level will cause the infant to wake up. However, this means that the monitor sound level must be turned up to be heard over any other sound, which can be distracting, particularly because at high sound levels, many conventional monitor receivers have poor sound quality. Further, if a babysitter is engaged in a telephone conversation or other activity that requires her to listen and commands her attention, supervision of the infant could be compromised.

It would therefore be beneficial to provide a remote sound monitor that provides an indication of the sound being monitored, but doesn't always require the supervisor's hearing or direct attention. For example, a visual indication that gives an immediate indication of a change in sound level being monitored and that can be observed from various vantage points in the vicinity of the receiver would be advantageous.

BRIEF SUMMARY OF THE INVENTION

According to one aspect of the present invention, a process for remotely monitoring a sound input includes converting a sound input to an audio signal having a parameter that corresponds to an amplitude of the sound input, and transmitting the audio signal. The audio signal is received at a location that is remote from the sound input, the parameter is processed, and a visual indication of the amplitude of the sound input is provided. The visual indication can be provided such that it is visible over a three-hundred-sixty degree range at the remote location.

According to a particular aspect of the present invention, the amplitude of the sound input is provided by providing a continuous visual indication if a comparison of the parameter of the audio signal to a predetermined threshold results in a first value, and providing an intermittent visual indication if the comparison of the parameter of the audio signal to the predetermined threshold results in a second value. In this case, an interval of intermittence of the intermittent visual indication can correspond to an extent that the parameter exceeds the threshold.

According to another particular aspect of the present invention, the amplitude of the sound input is provided by providing a visual indication of a first color if a comparison of the parameter of the audio signal to a predetermined threshold results in a first value, and providing a visual indication of a second color if the comparison of the parameter of the audio signal to the predetermined threshold results in a second value.

According to another particular aspect of the present invention, the amplitude of the sound input is provided by providing a visual indication of a first color when the parameter of the audio signal does not exceed a first predetermined threshold, providing a visual indication of a second color when the parameter of the audio signal exceeds the first predetermined threshold, providing a continuous visual indication when the parameter of the audio signal does not exceed a second predetermined threshold, and providing an intermittent visual indication when the parameter of the audio signal exceeds the second predetermined threshold. In this case, the second threshold can exceed the first threshold, or the first threshold can exceed the second threshold.

According to one structural aspect of the present invention, a receiver unit for a remote sound monitor includes an audio receiver that receives a transmitted audio signal having a parameter that corresponds to an amplitude of a remote sound input, and a display that provides a visual indication of the parameter of the audio signal. The parameter of the audio signal can be, for example, an amplitude of the audio signal, and the display can be a lamp.

The receiver unit can also include a base housing that encloses the audio receiver. The lamp can be a light source covered by a casing. For example, the light source can be recessed in the base housing, and the casing can be attached to the base housing over the recessed light source. Alternatively, the base housing can include a socket, and the light source can be coupled to the socket such that the light source extends from the base housing. In this case, the casing can be attached to the base housing and enclose the light source.

The light source can be, for example, a light emitting diode or a light bulb. The casing can be transparent or translucent, and can be, for example, an elongated structure, which can be hollow. This casing can extend above the base housing, and can extend to the extent that it rises above a highest elevation of the structure of the base housing. This allows the light emanating from the source to be visible from all angles around the receiver. The casing can be fabricated from a material such as acrylic, K-resin, crystal styrene, clarified ABS, or natural HDPE.

The receiver unit can also include a controller that controls the display in accordance with the parameter of the received audio signal. The controller can include a microprocessor, as well as an analog-to-digital converter, if necessary.

The controller can cause the display to provide the visual indication intermittently when the parameter of the received audio signal exceeds a predetermined threshold value. For example, the controller can include a comparator, a signal generator, and a display driver. The comparator can receive the audio signal and compare the parameter to the threshold value. The comparator provides a comparison result signal having either a first value or a second value indicative of the result of the comparison. The signal generator, for example, a square-wave generator, generates an intermittent signal. The display driver actuates the display continuously if the comparison result signal is the first value, and that actuates the display according to the intermittent signal if the comparison result signal is the second value. The threshold value can be made adjustable, for example, by including a potentiometer for providing the threshold value.

Alternatively, the controller can include a number of comparators, a signal generator, a selector, and a display driver. The comparators can receive the audio signal, and each comparator compares the parameter of the received audio signal to a respective threshold value. The comparators each provide a comparison result signal, each of which has a first value and a second value indicative of the result of the comparison. The signal generator generates a number of periodic signals, each corresponding to a comparator. From among all of the comparators providing a comparison result signal having the second value, the selector selects the periodic signal that corresponds to the comparator having the most extreme threshold value. The display driver actuates the display continuously if all of the comparators provide comparison results having the first value, and actuates the display according to the selected periodic signal if any comparator provides a comparison result having the second value. Preferably, the frequency of at least one of the periodic signals is different than a frequency of the other periodic signals. For example, respective frequencies of the periodic signals can correspond in magnitude to relative magnitudes of the respective thresholds of the corresponding comparators.

As another alternative, the controller can cause the display to change the visual indication from a first color to a second color when the parameter of the received audio signal exceeds a predetermined threshold value. In this case, the display can include a first light element that provides light of the first color, and a second light element that provides light of the second color. The controller can include a comparator, a first display driver, and a second display driver. The comparator receives the audio signal and compares the parameter to the threshold value. The comparator provides a comparison result signal having either a first value or a second value indicative of the result of the comparison. The first display driver actuates the first light element if the comparison result signal is the first value, and the second display driver actuates the second light element if the comparison result signal is the second value. The threshold value can be made adjustable, for example, by including a potentiometer for providing the threshold value. The light elements can be any colors. For example, the first light element can be green and the second light element can be red.

The foregoing features can be combined by considering the predetermined threshold value to be a first predetermined threshold value. In this case, the controller can cause the display to provide the visual indication intermittently based on a comparison of the parameter of the received audio signal to a second predetermined threshold value. Likewise, the comparator can be considered to be a first comparator and the comparison result signal to be a first comparison result signal. The controller can also include a second comparator, a signal generator, and a display driver. The second comparator receives the audio signal and compares the parameter to the second threshold value, to provide a second comparison result signal having either a first value or a second value indicative of the result of the comparison. The signal generator generates an intermittent signal. The display driver actuates the display continuously if the second comparison result signal is the first value, and actuates the display according to the intermittent signal if the second comparison result signal is the second value. The first threshold can exceed the second threshold, or the second threshold can exceed the first threshold.

According to another embodiment of the present invention, the light source can be a number of light emitting diodes. In addition, the base housing can have a top end, a bottom end, and an outer sidewall. The light emitting diodes are disposed in sequence on the outer sidewall. According to this embodiment, the casing can be a lens cover, which can be constructed from, for example, polycarbonate, polypropylene, or acrylic.

According to this embodiment, the receiver unit can also include a controller that controls the light emitting diodes based on the parameter of the received audio signal. The controller can include a microprocessor or an analog-to-digital converter, as necessary.

According to one aspect of this embodiment, at least one light emitting diode provides light that is a color that is different from a color of light provided by at least one other light emitting diode. In this case, the controller causes the light emitting diode(s) of the first color to provide the visual indication when the parameter of the received audio signal exceeds a predetermined threshold value, and causes the light emitting diode(s) of the second color to provide the visual indication when the parameter of the received audio signal does not exceed the predetermined threshold value. The controller can include a comparator, a first display driver, and a second display driver. The comparator receives the audio signal and compares the parameter to the threshold value. The comparator provides a comparison result signal having either a first value or a second value indicative of the result of the comparison. The first display driver actuates the first light emitting diode(s) if the comparison result signal is the first value, and the second display driver actuates the second light emitting diode(s) if the comparison result signal is the second value.

Alternatively, the controller can cause the light emitting diodes to provide the visual indication in a sequence based on a comparison of the parameter of the received audio signal with a predetermined threshold value. In this case, the controller includes a comparator, a signal generator, and a display driver. The comparator receives the audio signal and compares the parameter to the threshold value. The comparator provides a comparison result signal having either a first value or a second value indicative of the result of the comparison. The signal generator generates an intermittent signal. The display driver actuates at least one light emitting diode continuously if the comparison result signal is the first value, and actuates at least some of the light emitting diodes according to the intermittent signal if the comparison result signal is the second value.

According to another aspect of the present invention, the controller includes a number of comparators, a signal generator, a selector, and a display driver. The comparators receive the audio signal, and each comparator compares the parameter of the received audio signal to a respective threshold value. Each comparator provides a comparison result signal, each of which has either a first value or a second value indicative of the result of the comparison. The signal generator generates a number of periodic signals, each corresponding to a respective comparator. Among all of the comparators providing a comparison result signal having the second value, the selector selects the periodic signal that corresponds to the comparator having the most extreme threshold value. The display driver actuates at least one light emitting diode continuously if all of the comparators provide comparison results having the first value, and actuates at least some of the plurality of light emitting diodes according to the selected periodic signal if any comparator provides a comparison result having the second value. Preferably, the frequency of at least one of the periodic signals is different than the frequency of at least one other periodic signal. For example, respective frequencies of the periodic signals can correspond in magnitude to relative magnitudes of the respective thresholds of the corresponding comparators.

According to a particular embodiment of the present invention, the base housing can also include a spring-force biased clip attached to the top end of the base housing or the bottom end of the base housing. That end of the base housing can include a recessed portion and is otherwise flat, and the clip is attached to the base housing within the recessed portion and is completely disposed within the recessed portion. The top end of the base housing and the bottom end of the base housing can be round in cross-section.

The receiver unit can also include an audio speaker that converts the received audio signal to audible sound. An audio amplification circuit can also be included, to amplify the received audio signal and provide the amplified audio signal to the audio speaker. This audio amplification circuit can include noise-reduction circuitry that increases a signal-to-noise ratio of the amplified audio signal, and a switch that the user can use to actuate and de-actuate the audio amplification circuit. In addition to the amplifier on-off switch, the audio amplification circuit can include a gain selector so that the user can adjust the gain of the audio amplification circuit. The gain selector can include, for example, a potentiometer.

According to another aspect of the present invention, a remote sound monitor includes any embodiment of the receiver unit previously described, and a transmitter unit. The transmitter unit includes a sound transducer that receives the sound input and converts the sound input to the audio signal, and an audio transmitter that transmits the audio signal. The sound transducer can include a microphone, and a processor, if necessary, to provide the parameter. The sound transducer can be, for example, a digital sound transducer that provides a digital audio signal, in which case the audio transmitter is a digital audio transmitter and the audio receiver is a digital audio receiver.

According to one embodiment of the present invention, the transmitter unit includes a lamp, which can be a light source covered by a casing. The transmitter unit can also include a base housing that encloses the sound transducer and the audio transmitter. The light source can be recessed in the base housing. For example, the light source can be a light emitting diode. The casing can be attached to the base housing over the recessed light source. Alternatively, the base housing can include a socket, and the light source can be coupled to the socket such that the light source extends from the base housing. For example, the light source can be a light bulb, and the casing can be attached to the base housing and enclose the light source. The light source can include electro-luminescent material or thermo-luminescent material.

The casing can be transparent or translucent. The casing can be an elongated hollow structure, and can be fabricated from a material such as acrylic, K-resin, crystal styrene, clarified ABS, or natural HDPE.

DETAILED DESCRIPTION OF THE INVENTION

The process of the present invention allows for remotely monitoring a sound input. The sound input can be, for example, sounds that an infant makes in his sleep. This sound can be detected and captured, and then transmitted to a remote location where the sound is to be monitored. The sound input itself can be reproduced at the remote location, and generated through an audio speaker. Alternatively, or in addition, a visual indication of the amplitude of the sound input can also be provided at the remote location. A variation in the visual indication can be used to indicate a change in the amplitude of the sound input. For example, a visual indication in the form of a light can change color, or flash or strobe as an indication that the sound input amplitude has changed. If the remote sound monitor is an infant monitor, for example, the change in the visual indication can show that the infant has woken up and is making awake noises, or that the infant is crying and requires attention.

Figure 1:
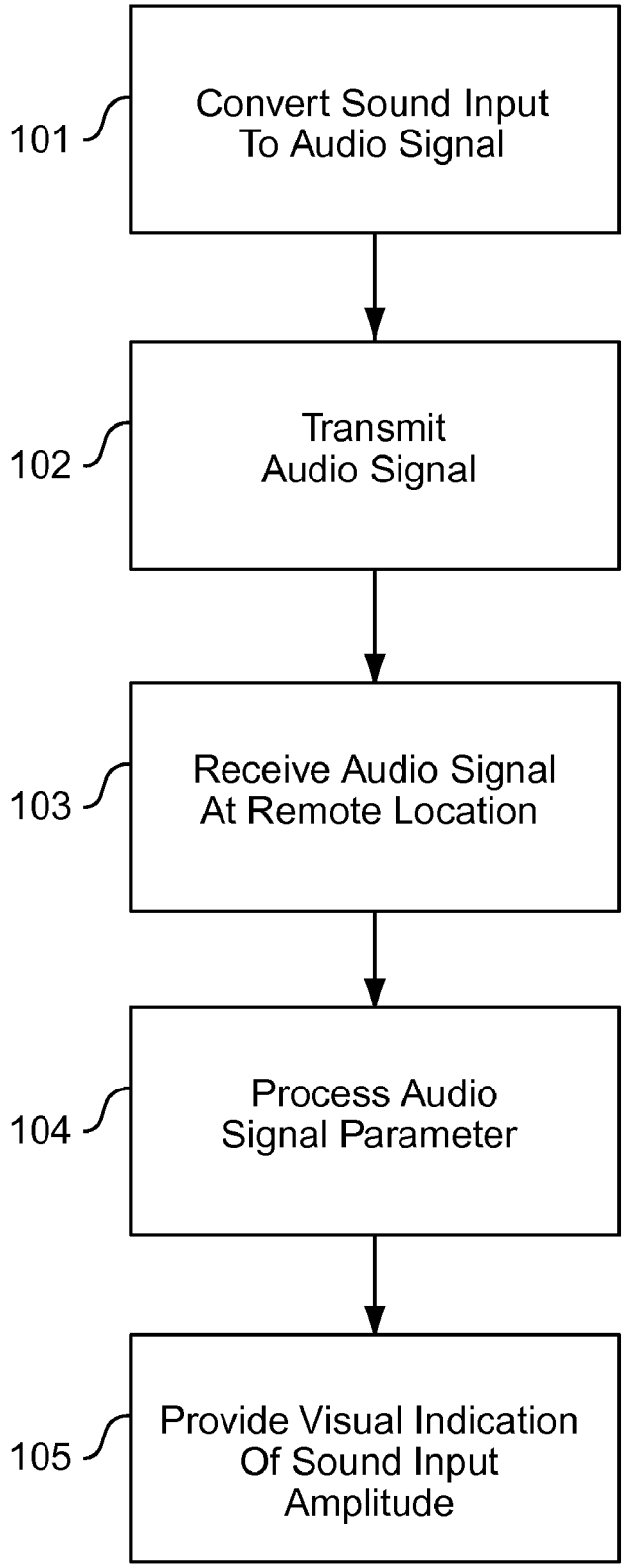
FIG. 1 is a flow diagram of an exemplary embodiment of a process of the present invention.

Referring to FIG. 1, a sound input is received and converted 101 to an audio signal. This audio signal has a parameter that corresponds to an amplitude of the sound input. For example, the audio signal can be an analog signal that has an amplitude that is proportional to the amplitude of the received sound input. Alternatively, the audio signal can be a digitized version of the received sound input that has a header or other message field that provides an indication of the amplitude of the sound input, or a range in which the amplitude of the sound input falls. The audio signal is transmitted 102. At the remote location, the audio signal is received 103, the parameter is processed 104, and a visual indication of the amplitude of the sound input is provided 105. The visual indication can be provided on any type of display, such as a video monitor or display, a series of light emitting diodes or liquid crystal displays, VU meters, or a display as simple as a lamp. In the case of the lamp, any variation in the light provided by the lamp can be an indication of the relative amplitude of the sound input. For example, a variation in intensity of the light provided by the lamp can indicate a change in the sound input amplitude, as can a change in color or refresh rate of the lamp.

Figure 2:
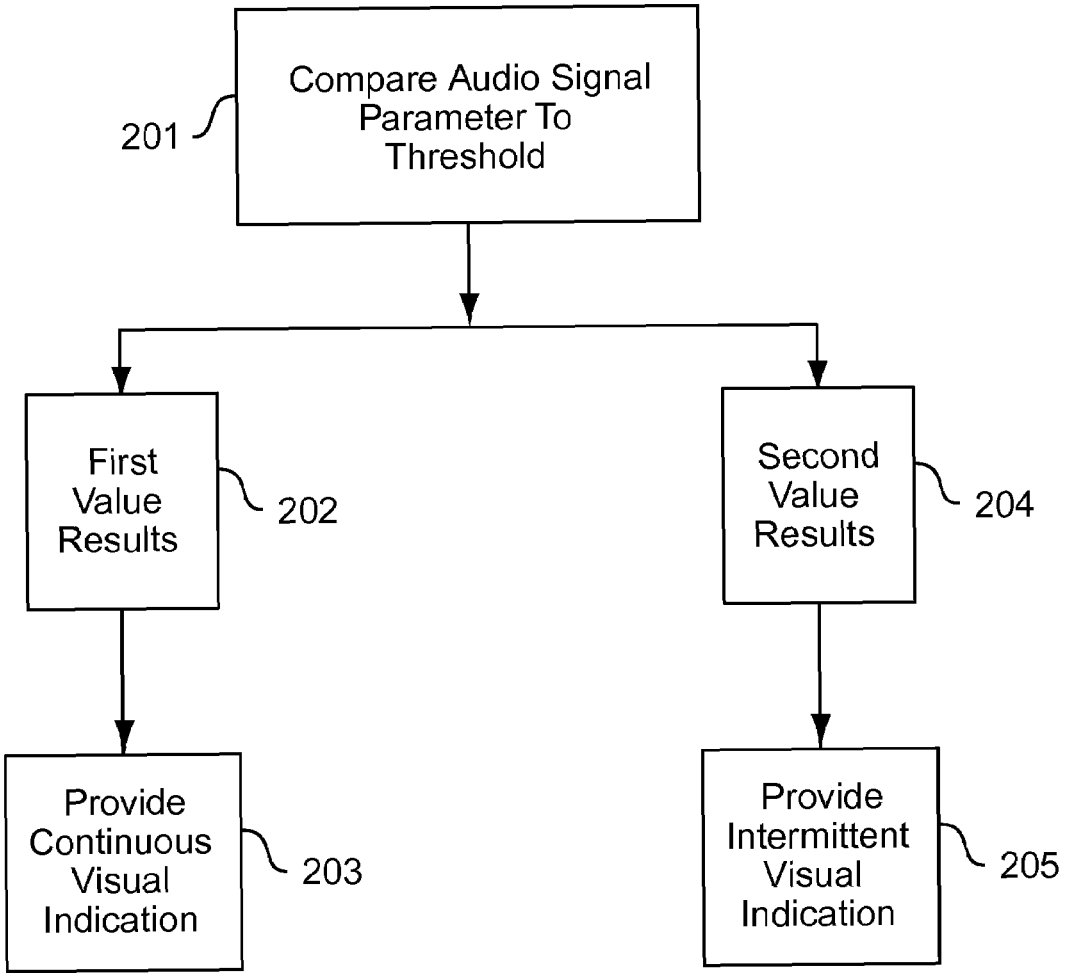
FIG. 2 is a flow diagram of a process providing an intermittent visual feature of the present invention.

Thus, it is contemplated that the visual indication of the amplitude of the sound input is provided 105 in any of a number of different ways. For example, if the visual indication is provided by a lamp, the lamp can provide a steady glow of light while the sound input remains low, below a threshold indicating that the infant is most likely asleep. This steady glow can change to a flashing light when the threshold is exceeded, indicating that the infant most likely is awake. If the sound input amplitude exceeds the threshold by a predetermined margin, or exceeds a second threshold, the lamp can flash at a different rate, such as at a higher frequency or rate of intermittence. Therefore, with reference to FIG. 2, a continuous visual indication of the sound input amplitude can be provided 203 if a comparison 201 of the parameter of the audio signal to a predetermined threshold results 202 in a first value, and an intermittent visual indication can be provided 205 if the comparison 201 of the parameter of the audio signal with the predetermined threshold results 204 in a second value. In this case, an interval of intermittence of the intermittent visual indication can correspond to an extent that the parameter exceeds the threshold.

Figure 3:
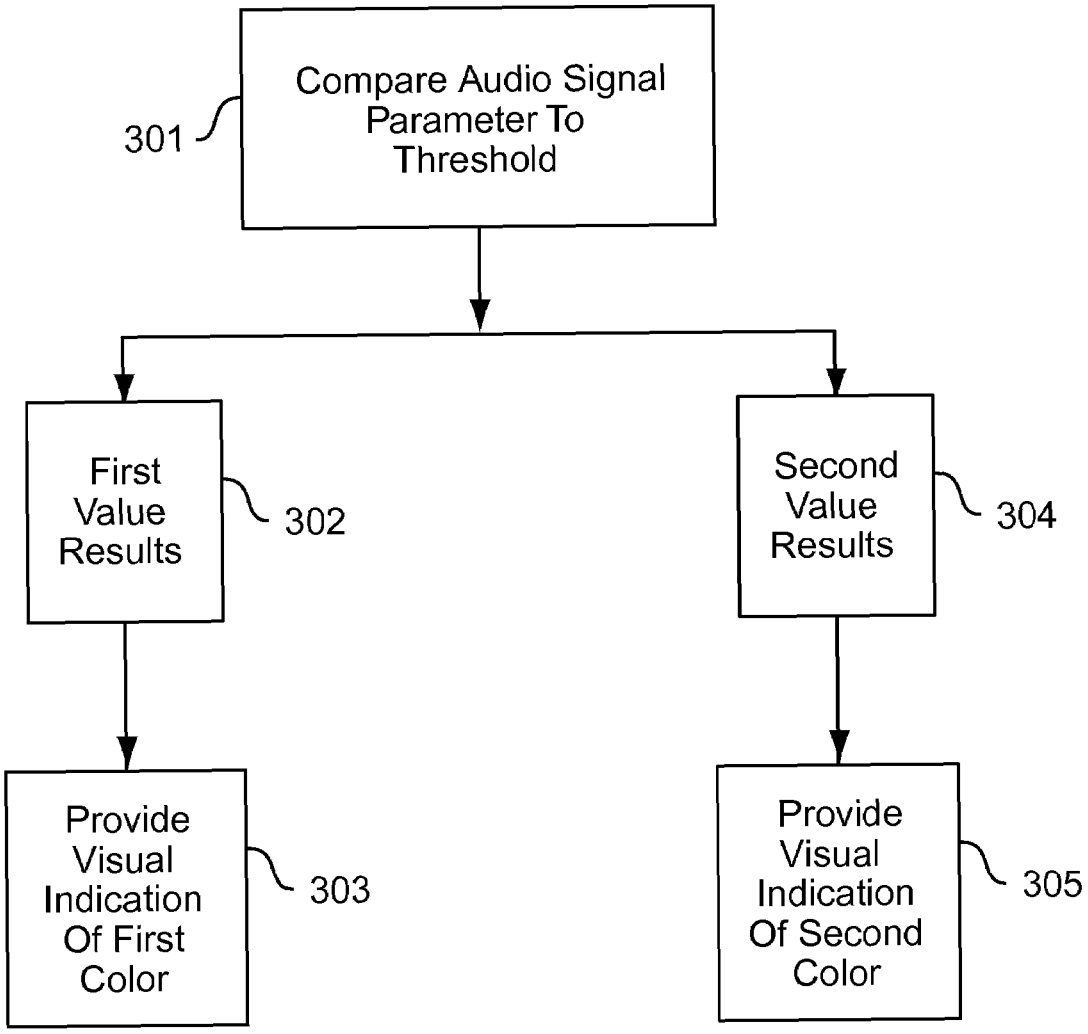
FIG. 3 is a flow diagram of a process providing a variable color visual feature of the present invention.

Alternatively, with reference to FIG. 3, the present invention can provide a visual indication of the amplitude of the sound input through the use of different colors at the receiver unit. For example, a low amplitude sound input, indicating that the infant most likely is sleeping, can result in a green glow provided by the lamp. If the sound input amplitude rises above a predetermined threshold, indicating that the infant is, most likely awake or crying, the lamp can change color, to glow red for example. Thus, a visual indication of a first color is provided 303 if a comparison 301 of the parameter of the audio signal with a predetermined threshold results 302 in a first value, and a visual indication of a second color is provided 305 if the comparison 301 of the parameter of the audio signal with the predetermined threshold results 304 in a second value.

Figure 4:
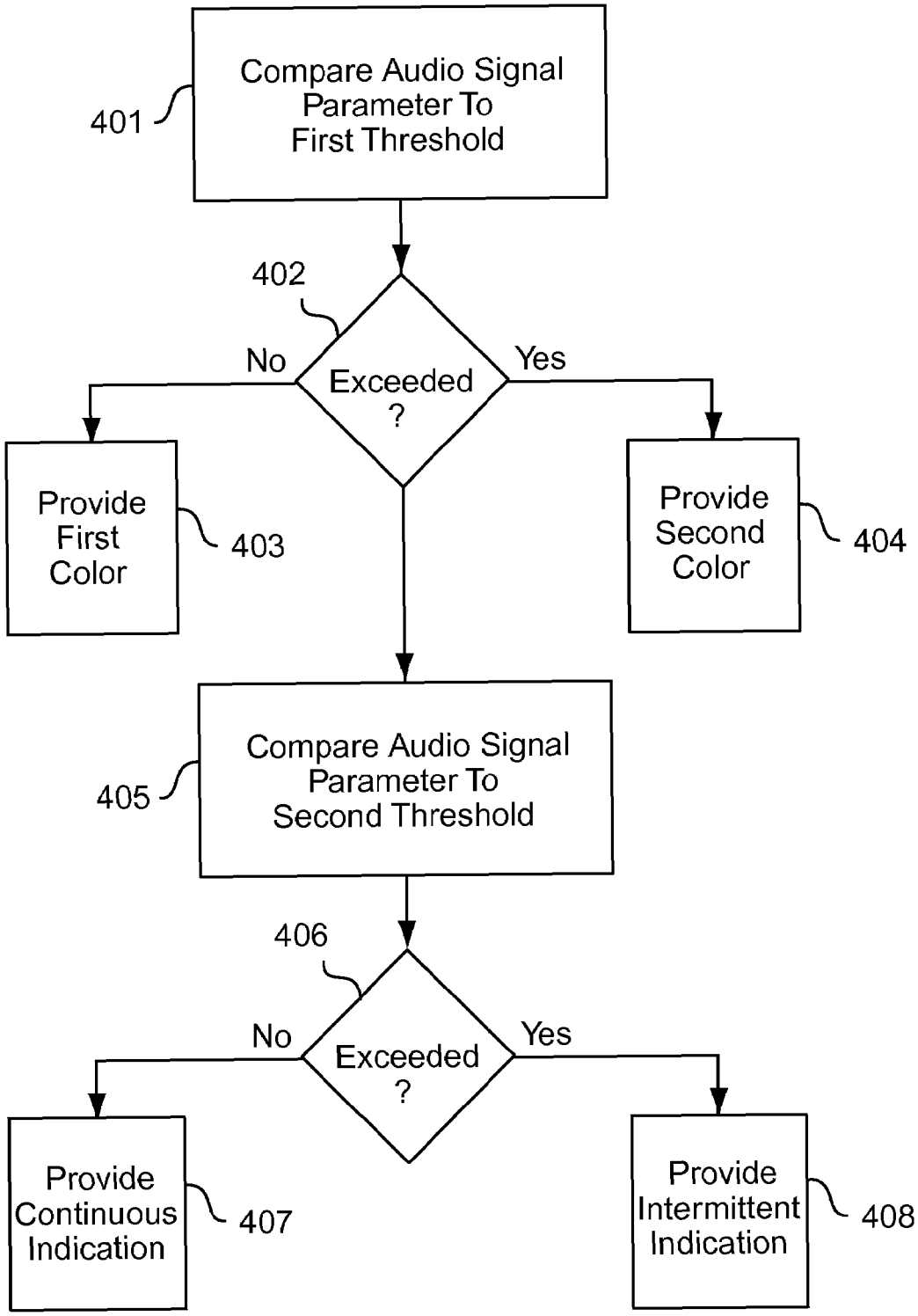
FIG. 4 is a flow diagram of a process providing a combination of visual features of the present invention.

As shown in FIG. 4, another embodiment of the present invention can provide indications of two or more levels of sound amplitude of the sound input, by using both color and intermittent display. That is, two thresholds are determined for the sound input amplitude, and a different indication is provided at the remote location for a sound input amplitude that exceeds the threshold. As shown, the audio signal parameter is compared 401 to a first threshold, and is also compared 406 to a second threshold. A visual indication of the first color is provided 403 when the parameter of the audio signal does not exceed 402 the first predetermined threshold, and a visual indication of the second color is provided 404 when the parameter of the audio signal does exceed 402 the first predetermined threshold. Likewise, a continuous visual indication is provided 407 when the parameter of the audio signal does not exceed 406 the second predetermined threshold, and an intermittent visual indication is provided 408 when the parameter of the audio signal does exceed 406 the second predetermined threshold. In this case, the second threshold can exceed the first threshold, or the first threshold can exceed the second threshold, depending on whether the color change or continuity change of the visual indication is the first indication of a notable increase in amplitude of the sound input.

Figure 5:
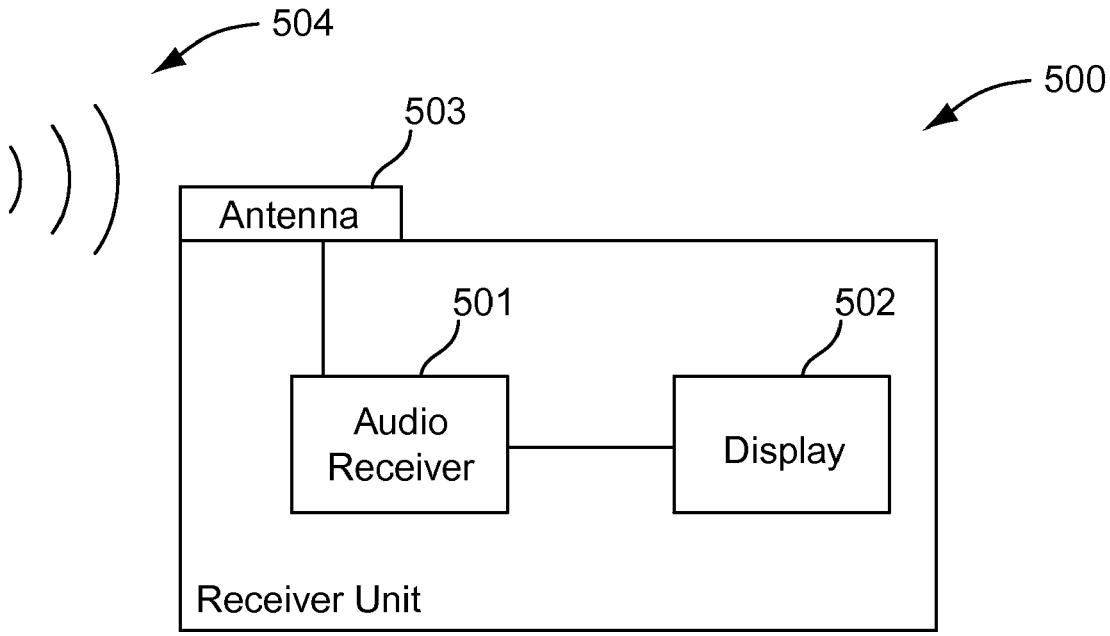
FIG. 5 is a block diagram of an exemplary receiver unit of the present invention.

FIG. 5 is a block diagram of an apparatus of the present invention, a receiver unit 500 for a remote sound monitor. According to this exemplary embodiment, the receiver unit 500 includes an audio receiver 501 that receives a transmitted audio signal 504, for example, via an antenna 503. The received audio signal has a parameter that corresponds to an amplitude of the remote sound input. As previously described, the parameter can be any indication of the amplitude of the sound input, a change in that amplitude, or a range of that amplitude. This indication can be a characteristic of the audio signal itself, such as the amplitude of the audio signal. Alternatively, this indication can be a parameter that is generated based on the sound input, such as a header or message field. The receiver unit 500 also includes a display 502, which provides a visual indication of the parameter of the audio signal.

Figure 6A:
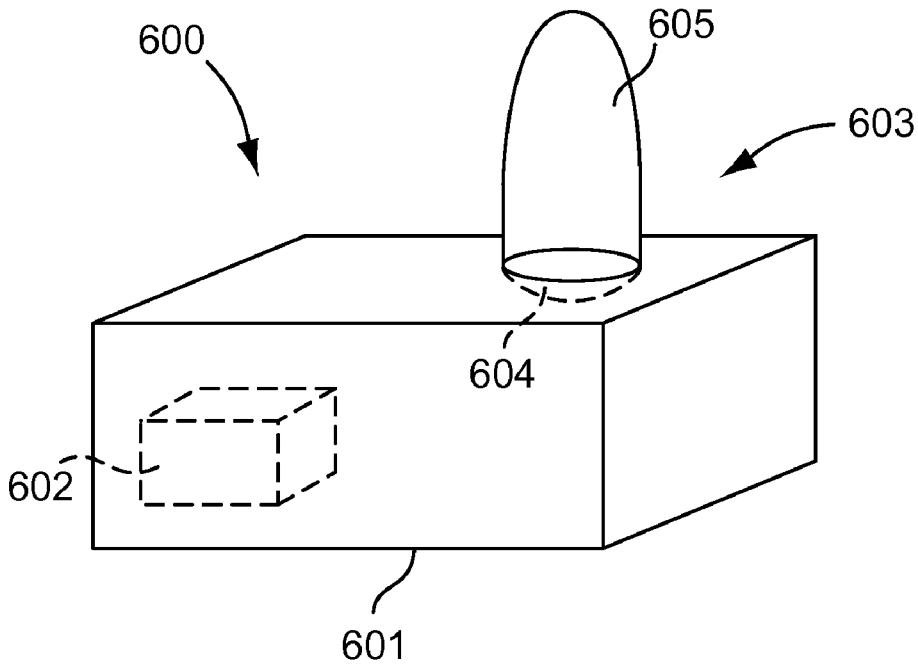
FIG. 6*a* is a rendering of an exemplary receiver unit of the present invention.
Figure 6B:
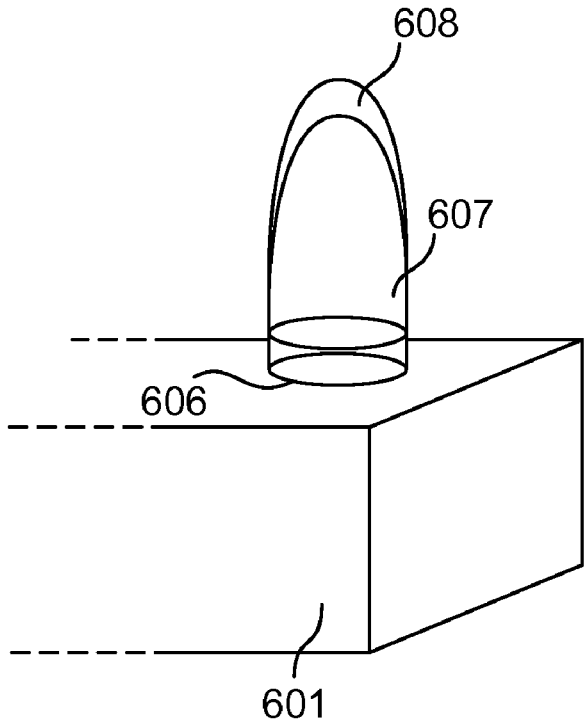
FIG. 6*b* is a rendering of an exemplary receiver unit of the present invention.

Physically, the receiver unit 600 can include a base housing 601 that encloses the audio receiver 602, as shown in FIG. 6*a*. As previously described, the display 603 can be a lamp. Although the display 603 can be any of a number of different structures, for the sake of brevity only a lamp or other lighting elements will be described. The lamp can be a light source 604 covered by a casing 605. For example, the light source 604 can be recessed in the base housing 601, and the casing 605 can be attached to the base housing 601 over the recessed light source 604. Alternatively, as shown in FIG. 6*b*, the base housing 601 can include a socket 606, and the light source 607 can be coupled to the socket 606 such that the light source 607 extends from the base housing 601. In this case, the casing 608 can be attached to the base housing 601 and enclose the light source 607. The casing 605, 608 is shown in both figures as a structure that extends from the base housing 601. This is preferred, so that the light emitted by the light source can be seen from all angles. However, it is contemplated that the casing can be merely a lens or other structure that does not extend from the base housing 601. Such an embodiment would still provide adequate visual indication, particularly if the receiver unit 600 is mounted on a wall. The light source 604, 607 can be, for example, a light emitting diode or a light bulb. The casing can be transparent or translucent, as long as light from the light source is able to be seen from outside the casing. The casing can be, for example, an elongated hollow structure, which allows light from a recessed light element 604 to pass through, and accommodates a light bulb 607 if necessary. The elongated structure can also be solid, as long as its properties allow the light to pass through. The casing 605, 608 can be fabricated from a material such as acrylic, K-resin, crystal styrene, clarified ABS, or natural HDPE.

Figure 7:
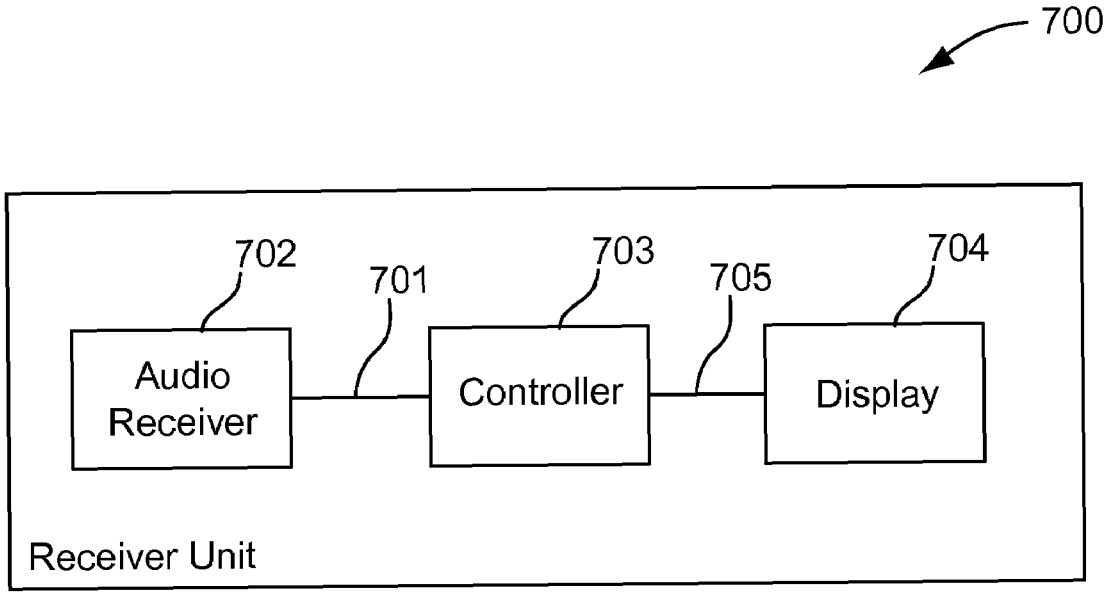
FIG. 7 is a block diagram of an exemplary receiver unit of the present invention.

As shown in block diagram form in FIG. 7, the receiver unit 700 can also include a controller 703 that controls the display 704 in accordance with the parameter of the received audio signal 701. That is, the audio receiver 702 provides the received audio signal 701 to the controller 703, which controls the display 704 according to the parameter of the received audio signal. The controller 703 can include a microprocessor to process the received audio signal 701 in order to derive the parameter, and to provide the control signal 705 to the display 704. Alternatively, a controller 703 in the form of discrete circuitry can be used to provide the control signal 705. If the received audio signal 701 is an analog signal, the controller 703 can include an analog-to-digital converter, if necessary.

As described previously, one way in which the receiver unit can provide a visual indication of the amplitude of the sound input is to cause the display to flash or strobe if the sound input amplitude rises above a predetermined threshold. Therefore, the controller can cause the display to provide the visual indication intermittently when the parameter of the received audio signal exceeds a predetermined threshold value set in the controller.

Figure 8:
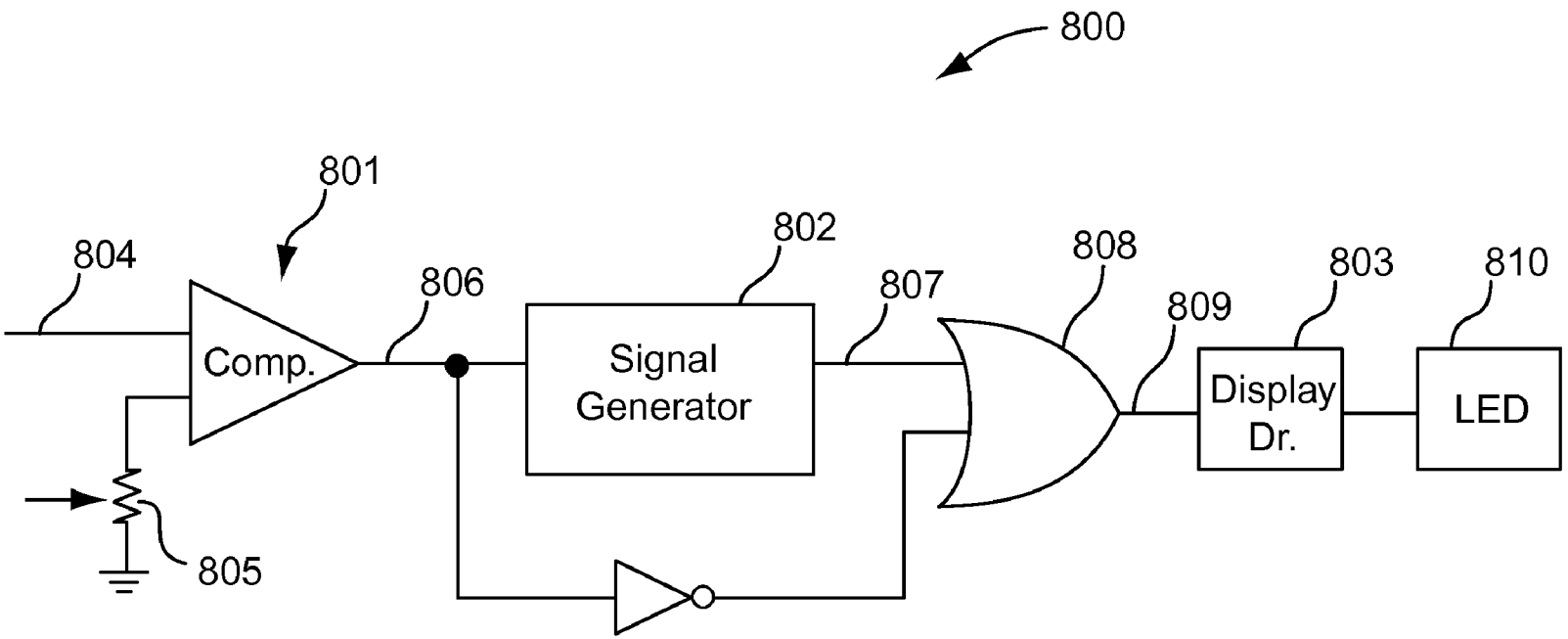
FIG. 8 is a schematic diagram of an exemplary receiver unit controller of the present invention.

For example, as shown in FIG. 8, the controller 800 can include a comparator 801, a signal generator 802, and a display driver 803. The comparator 801 receives the audio signal 804 and compares the parameter to the threshold value 805. The comparator 801 provides a comparison result signal 806 having either a first value or a second value indicative of the result of the comparison. For example, in the exemplary circuit shown in FIG. 8, if the audio signal parameter is the amplitude of the audio signal received by the comparator 801, the amplitude is compared to the threshold value 805. If the audio signal amplitude is greater than the threshold 805, the comparator result signal will be a logic "high" level. If the audio signal amplitude is not greater than the threshold 805, the comparator result signal 806 will remain a logic "low" level.

The signal generator 802 receives the comparator result signal 806 and is actuated if the comparator result signal 806 is a logic "high" level, in this example. On actuation, the signal generator 802 generates an intermittent output signal 807. For example, the signal generator 802 can be a square-wave generator or digital counter that generates a periodic square wave. The output of the signal generator 802 is intermittent, but need not be periodic. If the signal generator 802 is not actuated, that is, if the comparator result signal 806 is a logic "low" level, in this example, no intermittent signal is generated. An OR logic gate 808 is provided in this exemplary embodiment to receive the output of the signal generator 802 and an inverted comparator result signal 806. Thus, the output of the OR gate 808 is either a logic "high" level or an intermittent signal.

The output 809 of the OR gate is provided to a display driver 803, which in turn provides actuation for the light element, in this example, a light emitting diode 810. Thus, the display driver 803 actuates the display 810 continuously if the comparison result signal 806 is any first value, and that actuates the display according to the intermittent signal 807 if the comparison result signal 806 is a second value. The display driver 803 can be an active device, if necessary, such as if the light element is a light emitting diode 810 fabricated in a device package that requires a driver. If the light element is a more simple device, such as a bulb, the display driver might be a simple transformer device that provides the necessary current to cause the bulb to glow, or the light element can be driven directly, without the use of a driver at all. The threshold value 805 can be fixed, or it can be made adjustable, for example, through the use of a potentiometer, as shown.

Figure 9:
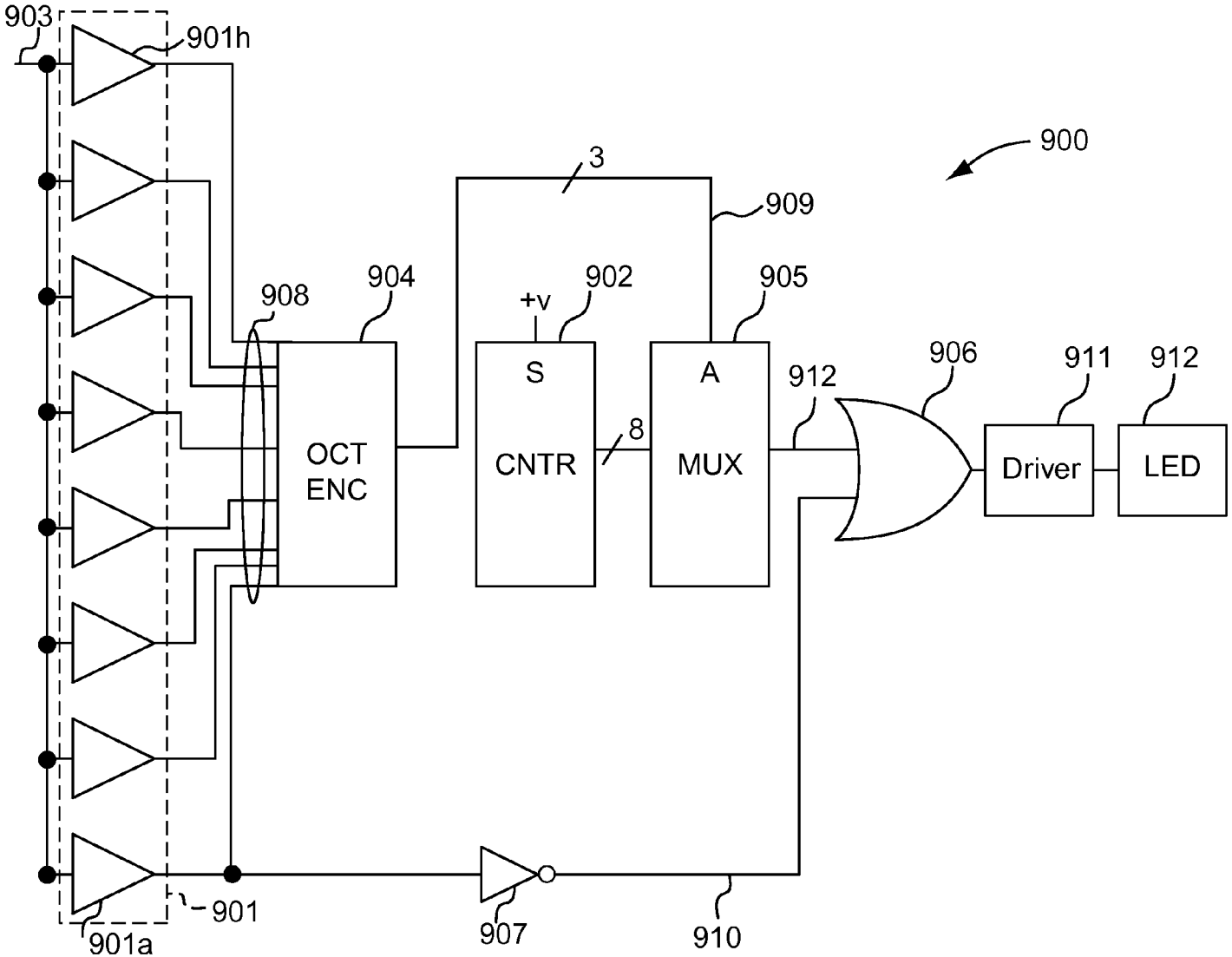
FIG. 9 is a schematic diagram of an exemplary receiver unit controller of the present invention.

In an alternative embodiment, rate of intermittence of the display increases as the amplitude of the sound input increases. The controller 900 in this embodiment includes a number of comparators 901, in this example eight comparators, as shown in FIG. 9. Each comparator receives the audio signal parameter 903 and compares it to a respective different threshold. In the exemplary embodiment shown, the parameter 903 is simply the amplitude of the audio signal. As shown in FIG. 9, the comparator at the lower end 901*a* compares the audio signal parameter 903 to the least extreme threshold, with the threshold extremity increasing in ascending order to the uppermost comparator 901*h*. An 8-bit digital counter 902 is used as a signal generator, with seven of the eight bits of the output used as potential driver signals for the display 903. Of the seven counter output bits used, the least significant bit has the highest frequency, and therefore corresponds to the comparator 901*h* having the most extreme threshold. Likewise, the most significant bit of the seven selected counter output bits has the lowest frequency, and therefore corresponds to the comparator 901*a* having the least extreme threshold.

Selection of the driving signal for the display 903 is provided by an octal-to-binary encoder 904, an 8-bit multiplexer 905, and an OR logic gate 906. The comparators 901 receive the audio signal parameter 903 and compare it to the respective thresholds. Each comparator generates a comparison result signal 908, all of which are provided to the encoder 904. In this exemplary embodiment, it is assumed that comparison results indicating that the threshold is exceeded provide a result signal having a "high" logic level. Thus, the output of the encoder 904 is a three-bit number indicating the designation of the highest threshold that is exceeded. This encoder output 909 is provided as the multiplexer 905 address, used by the multiplexer to select the appropriate counter bit to be used to drive the display 903. If none of the comparator thresholds is exceeded, all comparator outputs 908 will be a logic "low" level, including that of the lowest-order comparator 901*a*. Because this is an indication that the display 903 should be driven continuously, the inverted 907 lowest-order comparator result signal 910 is provided to the OR logic gate as a "high" logic level input, to provide continuous actuation of the display driver 911. If even the lowest-order comparator 901*a* threshold is exceeded, the inverted comparator result signal 910 will be a logic "low" level, and the multiplexer output will actuate the display driver 911.

Figure 10:
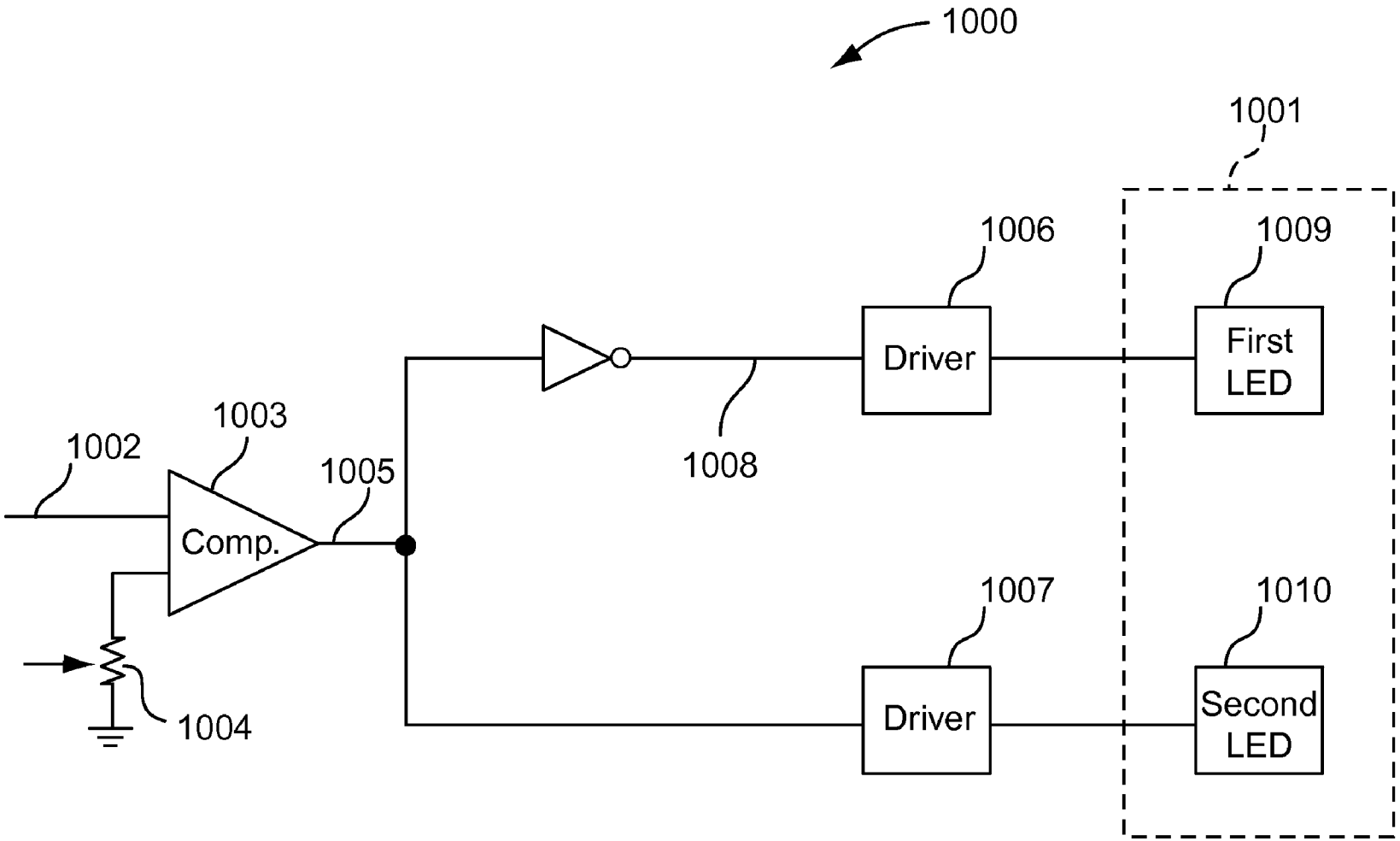
FIG. 10 is a schematic diagram of an exemplary receiver unit controller of the present invention.

In another embodiment, shown in FIG. 10, the controller 1000 causes the display 1001 to provide light of a first color when the audio signal parameter threshold is not exceeded, and to provide light of a second color when the audio signal parameter threshold is exceeded. As shown, the audio signal parameter 1002 is received by the comparator 1003, and is compared to the threshold 1004. The threshold 1004 can be fixed, or can be made adjustable through the use of a potentiometer, as shown. According to this exemplary embodiment, the audio signal parameter 1002 is simply the amplitude of the received audio signal. This amplitude is compared to the threshold 1004, and the resulting comparator result signal 1005 is either a logic "low" level if the threshold 1004 is not exceeded, or a logic "high" level if the threshold 1004 is exceeded. Two display drivers 1006, 1007 are provided, each adapted to drive a respective light element 1009, 1010 of the display 1001. According to this particular embodiment, the first light element 1009 provides a light that is a different color than that of the light provided by the second light element 1010. An inverted comparator result signal 1008 is provided to the first display driver 1006, which is actuated by a logic "high" level. Thus, the first driver 1006 will drive the first light element 1009 when the comparator result signal 1005 is a logic "low" level, that is, when the threshold 1004 has not been exceeded by the audio input parameter 1002. Likewise, the comparator result signal 1005 is provided to the second display driver 1007, which is actuated by a logic "high" level. Thus, the second driver 1007 will drive the second light element 1010 when the comparator result signal 1005 is a logic "high" level, that is, when the threshold 1004 has been exceeded by the audio input parameter 1002. Therefore, a sound input below the amplitude threshold causes the display 1001 to provide light of a first color (for example, green), and a sound input above the amplitude threshold causes the display 1001 to provide light of a second color (for example, red).

It will be apparent to those of skill in the art that two parameter thresholds can be used to provide the color-change indication described previously, as well as the indication of the intermittent display. For example, a circuit such as that shown in the exemplary embodiment of FIG. 10 can be used in combination with the circuit such as that shown in the exemplary embodiment of FIG. 8 to provide two separate audio signal parameter thresholds. For example, the first threshold can be used to determine whether the display will provide light of the first color or light of the second color. Likewise, the second threshold can be used to determine whether the display provides continuous light or intermittent light. Either threshold can be set to be the more extreme of the two. For example, a particular embodiment can use green as a first color and red as a second color, and can set the color threshold to be less extreme than the intermittence threshold. In this case, low level "sleeping" sounds by the infant at the remote location will cause the display to provide a steady green light. Higher level "awake" sounds will cause the display to change to red light. The highest level "crying" sounds will cause the red light to flash. Alternatively, if the second threshold is set to be less extreme than the first threshold, low level sounds will cause the display to provide a steady green light, higher level sounds will cause the display to flash green, and highest level sounds will cause the flashing light to turn red.

Figure 11:
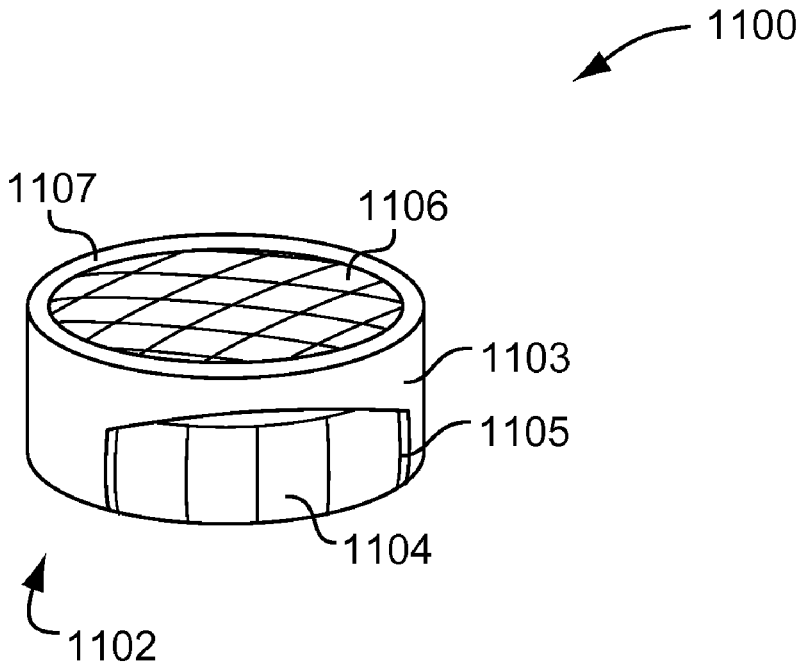
FIG. 11 is a rendering of an exemplary receiver unit of the present invention.

An alternative embodiment of the receiver unit can have a number of light emitting diodes as the light source. As shown in FIG. 11, the base housing 1100 of this embodiment has a top end 1101, a bottom end 1102, and an outer sidewall 1103. The light emitting diodes 1104 are disposed in sequence on the outer sidewall 1103. In this particular embodiment, the casing is a lens cover 1105. The lens cover 1105 can be constructed from any of a number of materials, such as polycarbonate, polypropylene, or acrylic.

This particular embodiment of the receiver unit can also include a controller, which controls the light emitting diodes 1104 based on the parameter of the received audio signal. Similarly to the other described embodiments, the light emitting diodes 1104 can provide light of more than one color, so that at least one light emitting diode in the series provides light of a color that is different from the color of light provided by at least one other light emitting diode. The controller can operate much the same as the controller described previously with reference to FIG. 10. In this embodiment, however, either the first light element 1009 or the second light element 1010, or both light elements, can include more than one light emitting diode of the same color, or of different but mutually exclusive colors.

Likewise, similarly to the embodiments shown in FIGS. 8 and 9, the controller can cause the light emitting diodes 1104 to flash intermittently on determining that the audio signal parameter exceeds one or more comparator thresholds. Those of ordinary skill in the art will also recognize that the circuit of FIG. 9 can be modified to light or flash the light emitting diodes 1104 in a sequence, determined by the number of thresholds exceeded by the audio input parameter 903 and driven by the encoder output 904. Of course, all of these functions can be provided by equivalent circuits or by a microprocessor, and not necessarily by the exemplary embodiments shown and described herein.

Figure 12:
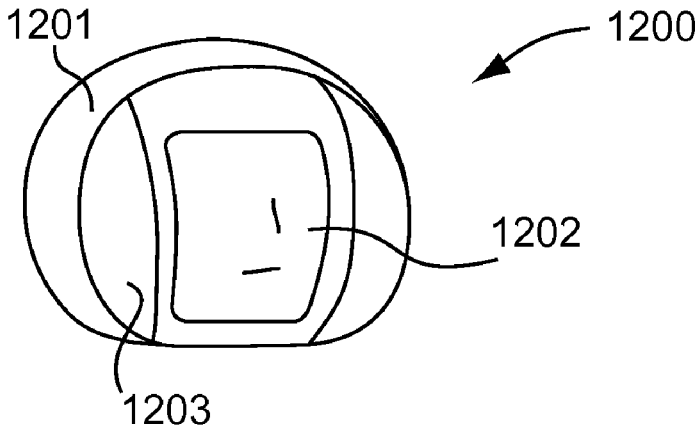
FIG. 12 is a rendering of an exemplary receiver unit of the present invention.

The base housing 1201 of the receiver unit 1200 in a portable embodiment shown in FIG. 12 includes a spring-force biased clip 1202 or other clasp attached to the top end or bottom end of the base housing 1201. The clip 1202 allows the receiver unit 1200 to be attached to a belt, pocket, or other portion of a user's clothing, or to a handbag, backpack, or other carrier. The end of the base housing 1201 with the clip 1202 preferably has a recessed portion 1203 and is otherwise flat, so that the clip 1202 can be attached to the base housing 1201 completely within the recessed portion 1203. This allows the portable embodiment to be laid flat on a table or other surface. As shown, the base housing 1201 is preferably round in cross-section or has rounded edges.

Figure 13:
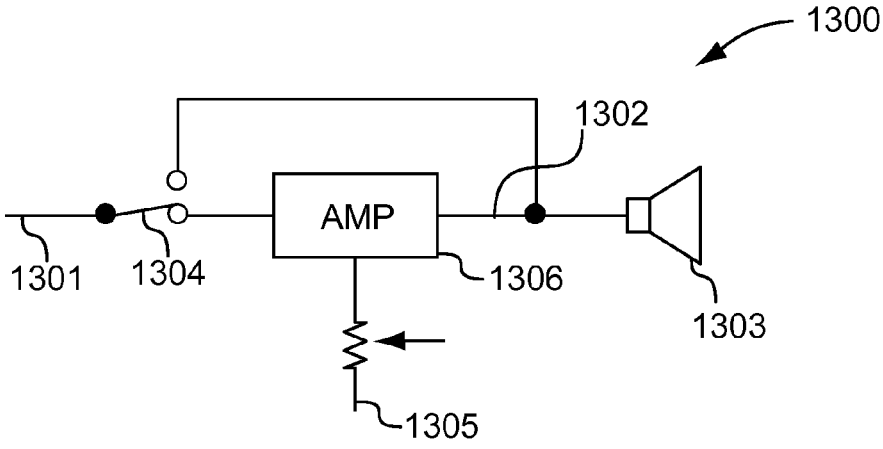
FIG. 13 is a schematic diagram of an exemplary amplification circuit of the present invention.

Any embodiment of the receiver unit can also include an audio speaker that converts the received audio signal to audible sound. For example, FIG. 11 shows an audio speaker 1106 on the side of the portable configuration that does not have the clip 1202. An audio amplification circuit 1300 can also be included, as shown in FIG. 13. The amplification circuit 1300 can be any circuit known to those skilled in the art that can amplify the received audio signal 1301 and provide the amplified audio signal 1302 to the audio speaker 1303. This audio amplification circuit 1300 can include noise-reduction circuitry that increases the signal-to-noise ratio of the amplified audio signal 1302. A switch 1304 is included for actuation by a user that inserts and removes the audio amplification circuit 1300 from the audio signal path. In addition to the amplifier on-off switch 1304, the audio amplification circuit 1300 can include a gain selector 1305 so that the user can adjust the gain of the audio amplification circuit 1300. As shown, the gain selector 1305 can include, for example, a potentiometer.

Figure 14:
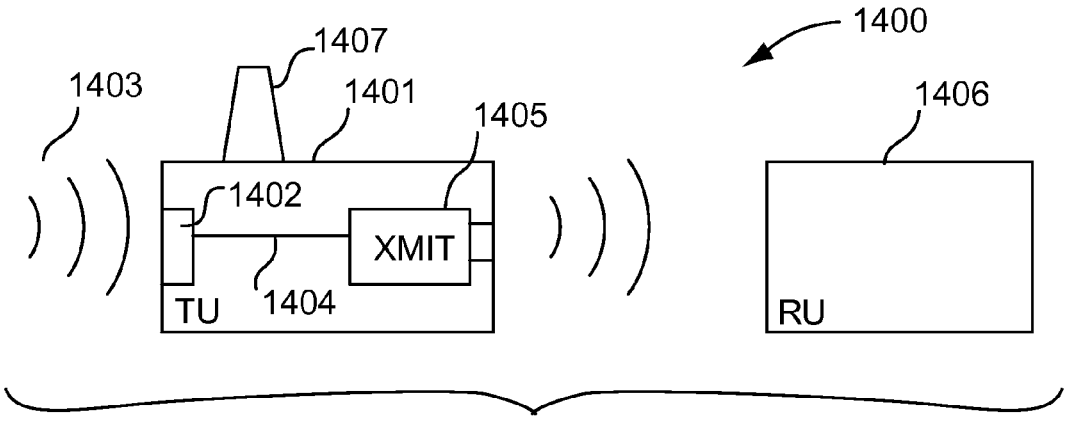
FIG. 14 is a block diagram of a remote monitoring system according to the present invention.

In addition to the receiver unit, the present invention can also include transmitter unit 1401, to provide a complete remote sound monitor 1400, as shown in FIG. 14. The transmitter unit 1401 includes a sound transducer 1402 that receives the sound input 1403 and converts the sound input 1403 to the audio signal 1404, and an audio transmitter 1405 that transmits the audio signal 1404 to the receiver unit 1406. The sound transducer 1402 can be, for example, a microphone. The sound transducer 1402 can also include a processor, if necessary, to provide the audio signal parameter that will be compared to the threshold(s) at the receiver unit 1406. Thus, the sound transducer 1402 can be, for example, a digital sound transducer that provides a digital audio signal, in which case the audio transmitter is a digital audio transmitter and the audio receiver is a digital audio receiver.

According to one embodiment of the present invention, the transmitter unit 1401 also includes a lamp 1407, which can be a light source covered by a casing similar to that of the receiver unit 1406 as shown in FIGS. 6*a* and 6*b*. This lamp can be a nightlight for the infant's room. Because the transmitter unit 1401 is placed nearby to the infant while the infant is sleeping, the lamp 1407 preferably provides a soft glow rather than a bright light.

Similarly to the receiver unit, the transmitter unit can include a base housing that encloses the sound transducer and the audio transmitter. Like the receiver light source, the transmitter light source can be a light emitting diode or a light bulb, or can be a structure formed of electro-luminescent material or thermo-luminescent material. As previously described with respect to the receiver unit, the transmitter unit light source can be recessed in the base housing and the casing can be attached to the base housing over the recessed light source. Alternatively, the base housing can include a socket, the light source can be coupled to the socket such that the light source extends from the base housing, and the casing can be an elongated hollow structure that fits over the light source. The casing can be transparent or translucent, and can be fabricated from a material such as acrylic, K-resin, crystal styrene, clarified ABS or natural HDPE.

I claim:

1. A receiver unit for a remote sound monitor, comprising:

an audio receiver that receives a transmitted audio signal having a parameter that corresponds to an amplitude of a remote sound input;

a display that provides a visual indication of the parameter of the audio signal; and a base housing that encloses the audio receiver;

wherein the display is a lamp;

wherein the lamp is a light source covered by a casing;

wherein the light source is recessed in the base housing;

wherein the casing is attached to the base housing over the recessed light source; and wherein the base housing includes a socket, and the light source is coupled to the socket such that the light source extends from the base housing.

2. The receiver unit of claim 1, wherein the casing is attached to the base housing and encloses the light source.

3. The receiver unit of claim 1, wherein the parameter of the audio signal is an amplitude of the audio signal.

4. A receiver unit for a remote sound monitor, comprising:

an audio receiver that receives a transmitted audio signal having a parameter that corresponds to an amplitude of a remote sound input;

a display that provides a visual indication of the parameter of the audio signal; and a base housing that encloses the audio receiver;

wherein the display is a lamp;

wherein the lamp is a light source covered by a casing; and wherein the casing is an elongated hollow structure.

5. The receiver unit of claim 4, wherein the casing extends above a highest elevation of the structure of the base housing.

6. The receiver unit of claim 4, wherein the light source is recessed in the base housing.

7. The receiver unit of claim 6, wherein the casing is attached to the base housing over the recessed light source.

8. The receiver unit of claim 4, wherein the light source is a light emitting diode.

9. The receiver unit of claim 4, wherein the light source is a light bulb.

10. The receiver unit of claim 4, wherein the casing is transparent.

11. The receiver unit of claim 4, wherein the casing is translucent.

12. The receiver unit of claim 4, wherein the parameter of the audio signal is an amplitude of the audio signal.

13. A receiver unit for a remote sound monitor, comprising:

an audio receiver that receives a transmitted audio signal having a parameter that corresponds to an amplitude of a remote sound input;

a display that provides a visual indication of the parameter of the audio signal; and a base housing that encloses the audio receiver;

wherein the display is a lamp;

wherein the lamp is a light source covered by a casing; and wherein the casing is fabricated from at least one material selected from the group consisting of acrylic, K-resin, crystal styrene, clarified ABS, and natural HDPE.

14. A receiver unit for a remote sound monitor, comprising:

an audio receiver that receives a transmitted audio signal having a parameter that corresponds to an amplitude of a remote sound input;

a display that provides a visual indication of the parameter of the audio signal; and a base housing that encloses the audio receiver;

wherein the display is a lamp;

wherein the lamp is a light source covered by a casing;

wherein the light source is recessed in the base housing;

wherein the casing is attached to the base housing over the recessed light source;

wherein the light source is a plurality of light emitting diodes;

wherein the base housing has a top end, a bottom end, and an outer sidewall, and the plurality of light emitting diodes are disposed in sequence on the outer sidewall;

wherein the receiver unit further includes a controller that controls the plurality of light emitting diodes based on the parameter of the received audio signal;

wherein the controller causes the plurality of light emitting diodes to provide the visual indication in a sequence based on a comparison of the parameter of the received audio signal with a predetermined threshold value; and wherein the controller includes:

a comparator that receives the audio signal and compares the parameter to the threshold value, to provide a comparison result signal having one of a first value and a second value indicative of the result of the comparison;

a signal generator that generates an intermittent signal; and a display driver that actuates at least one light emitting diode of the plurality of light emitting diodes continuously if the comparison result signal is the first value, and that actuates at least some of the plurality of light emitting diodes according to the intermittent signal if the comparison result signal is the second value.

15. A receiver unit for a remote sound monitor, comprising:

an audio receiver that receives a transmitted audio signal having a parameter that corresponds to an amplitude of a remote sound input;

a display that provides a visual indication of the parameter of the audio signal; and a base housing that encloses the audio receiver;

wherein the display is a lamp;

wherein the lamp is a light source covered by a casing;

wherein the light source is recessed in the base housing;

wherein the casing is attached to the base housing over the recessed light source;

wherein the light source is a plurality of light emitting diodes;

wherein the base housing has a top end, a bottom end, and an outer sidewall, and the plurality of light emitting diodes are disposed in sequence on the outer sidewall;

wherein the receiver unit further includes a controller that controls the plurality of light emitting diodes based on the parameter of the received audio signal;

wherein the controller causes the plurality of light emitting diodes to provide the visual indication in a sequence based on a comparison of the parameter of the received audio signal with a predetermined threshold value; and wherein the controller includes:

a plurality of comparators that receive the audio signal, wherein each comparator of the plurality of comparators compares the parameter of the received audio signal to a respective one of the plurality of threshold values, to provide a plurality of respective comparison result signals, each having one of a first value and a second value indicative of the result of the comparison;

a signal generator that generates a plurality of periodic signals corresponding to respective ones of the plurality of comparators;

a selector that selects a one of the periodic signals that corresponds to the comparator having the most extreme threshold value among all of the comparators providing a comparison result signal having the second value; and a display driver that actuates at least one light emitting diode of the plurality of light emitting diodes continuously if all of the plurality of comparators provide comparison results having the first value, and that actuates at least some of the plurality of light emitting diodes according to the selected periodic signal if any comparator provides a comparison result having the second value.

16. The receiver unit of claim 15, wherein a frequency of at least one of the plurality of periodic signals is different than a frequency of at least one other of the plurality of periodic signals.

17. The receiver unit of claim 15, wherein respective frequencies of the plurality of periodic signals correspond in magnitude to relative magnitudes of the respective thresholds of the corresponding comparators.

18. The receiver unit of claim 15, wherein the casing is a lens cover.

19. The receiver unit of claim 18, wherein the lens cover is constructed from material including at least one of polycarbonate, polypropylene, and acrylic.

20. The receiver unit of claim 15, wherein the controller includes a microprocessor.

21. The receiver unit of claim 15, wherein the controller includes an analog-to-digital converter.

22. The receiver unit of claim 15, wherein at least one light emitting diode of the plurality of light emitting diodes provides light that is a color that is different from a color of light provided by at least another light emitting diode of the plurality of light emitting diodes.

23. The receiver unit of claim 22, wherein the controller causes the at least one light emitting diode to provide the visual indication when the parameter of the received audio signal exceeds a predetermined threshold value, and the controller causes the at least another light emitting diode to provide the visual indication when the parameter of the received audio signal does not exceed the predetermined threshold value.

24. The receiver unit of claim 23, wherein the controller includes:

a comparator that receives the audio signal and compares the parameter to the threshold value, to provide a comparison result signal having one of a first value and a second value indicative of the result of the comparison;

a first display driver that actuates the at least one light emitting diode if the comparison result signal is the first value; and a second display driver that actuates the at least another light emitting diode if the comparison result signal is the second value.

25. The receiver unit of claim 15, wherein the base housing further includes a spring-force biased clip attached to one of the top end of the base housing and the bottom end of the base housing.

26. The receiver unit of claim 25, wherein the one of the top end of the base housing and the bottom end of the base housing includes a recessed portion and is otherwise flat, and wherein the spring-force biased clip is attached to the base housing within the recessed portion and is completely disposed within the recessed portion.

27. The receiver unit of claim 15, wherein the top end of the base housing and the bottom end of the base housing are round in cross-section.

28. A receiver unit for a remote sound monitor, comprising:

an audio receiver that receives a transmitted audio signal having a parameter that corresponds to an amplitude of a remote sound input;

a display that provides a visual indication of the parameter of the audio signal; and a controller that controls the display in accordance with the parameter of the received audio signal;

wherein the controller causes the display to provide the visual indication intermittently when the parameter of the received audio signal exceeds a predetermined threshold value;

wherein the controller includes:

a comparator that receives the audio signal and compares the parameter to the threshold value, to provide a comparison result signal having one of a first value and a second value indicative of the result of the comparison;

a signal generator that generates an intermittent signal; and a display driver that actuates the display continuously if the comparison result signal is the first value, and that actuates the display according to the intermittent signal if the comparison result signal is the second value.

29. The receiver unit of claim 28, wherein the threshold value is adjustable.

30. The receiver unit of claim 29, further including a potentiometer for providing the threshold value.

31. The receiver unit of claim 28, wherein the signal generator is a square-wave generator.

32. A receiver unit for a remote sound monitor, comprising:

an audio receiver that receives a transmitted audio signal having a parameter that corresponds to an amplitude of a remote sound input;

a display that provides a visual indication of the parameter of the audio signal; and a controller that controls the display in accordance with the parameter of the received audio signal;

wherein the controller causes the display to provide the visual indication intermittently when the parameter of the received audio signal exceeds a predetermined threshold value;

wherein the controller includes:

a plurality of comparators that receive the audio signal, wherein each comparator of the plurality of comparators compares the parameter of the received audio signal to a respective one of a plurality of threshold values, to provide a plurality of respective comparison result signals, each having one of a first value and a second value indicative of the result of the comparison;

a signal generator that generates a plurality of periodic signals corresponding to respective ones of the plurality of comparators;

a selector that selects a one of the periodic signals that corresponds to the comparator having the most extreme threshold value among all of the comparators providing a comparison result signal having the second value; and a display driver that actuates the display continuously if all of the plurality of comparators provide comparison results having the first value, and that actuates the display according to the selected periodic signal if any comparator provides a comparison result having the second value.

33. The receiver unit of claim 32, wherein a frequency of at least one of the plurality of periodic signals is different than a frequency of at least one other of the plurality of periodic signals.

34. The receiver unit of claim 32, wherein respective frequencies of the plurality of periodic signals correspond in magnitude to relative magnitudes of the respective thresholds of the corresponding comparators.

35. The receiver unit of claim 32, wherein the controller includes a microprocessor.

36. The receiver unit of claim 32, wherein the controller includes an analog-to-digital converter.

37. A receiver unit for a remote sound monitor, comprising:

an audio receiver that receives a transmitted audio signal having a parameter that corresponds to an amplitude of a remote sound input;

a display that provides a visual indication of the parameter of the audio signal; and a controller that controls the display in accordance with the parameter of the received audio signal;

wherein the controller causes the display to change the visual indication from a first color to a second color when the parameter of the received audio signal exceeds a predetermined threshold value;

wherein the display includes a first light element that provides light of the first color, and a second light element that provides light of the second color;

wherein the controller includes:

a comparator that receives the audio signal and compares the parameter to the threshold value, to provide a comparison result signal having one of a first value and a second value indicative of the result of the comparison;

a first display driver that actuates the first light element if the comparison result signal is the first value; and a second display driver that actuates the second light element if the comparison result signal is the second value; and wherein the threshold value is adjustable.

38. The receiver unit of claim 37, further including a potentiometer for providing the threshold value.

39. The receiver unit of claim 37, wherein the first light element is green.

40. The receiver unit of claim 37, wherein the second light element is red.

41. A receiver unit for a remote sound monitor, comprising:

an audio receiver that receives a transmitted audio signal having a parameter that corresponds to an amplitude of a remote sound input;

a display that provides a visual indication of the parameter of the audio signal; and a controller that controls the display in accordance with the parameter of the received audio signal;

wherein the controller causes the display to change the visual indication from a first color to a second color when the parameter of the received audio signal exceeds a predetermined threshold value;

wherein the display includes a first light element that provides light of the first color, and a second light element that provides light of the second color;

wherein the controller includes:

a comparator that receives the audio signal and compares the parameter to the threshold value, to provide a comparison result signal having one of a first value and a second value indicative of the result of the comparison;

a first display driver that actuates the first light element if the comparison result signal is the first value; and a second display driver that actuates the second light element if the comparison result signal is the second value;

wherein the predetermined threshold value is a first predetermined threshold value, and wherein the controller causes the display to provide the visual indication intermittently based on a comparison of the parameter of the received audio signal to a second predetermined threshold value.

42. The receiver unit of claim 41, wherein the comparator is a first comparator and the comparison result signal is a first comparison result signal, and the controller further includes:

a second comparator that receives the audio signal and compares the parameter to the second threshold value, to provide a second comparison result signal having one of a first value and a second value indicative of the result of the comparison;

a signal generator that generates an intermittent signal; and a third display driver that actuates the display continuously if the second comparison result signal is the first value, and that actuates the display according to the intermittent signal if the second comparison result signal is the second value.

43. The receiver unit of claim 42, wherein the first threshold exceeds the second threshold.

44. The receiver unit of claim 42, wherein the second threshold exceeds the first threshold.

45. A remote sound monitor comprising a receiver unit and a transmitter unit, wherein the receiver unit includes an audio receiver that receives a transmitted audio signal having a parameter that corresponds to an amplitude of a remote sound input; and a display that provides a visual indication of the parameter of the audio signal; and wherein the transmitter unit includes a sound transducer that receives the sound input and converts the sound input to the audio signal;

an audio transmitter that transmits the audio signal; and a lamp;

wherein the lamp is a light source covered by a casing;

wherein the transmitter unit includes a base housing that encloses the sound transducer and the audio transmitter; and wherein the base housing includes a socket, and the light source is coupled to the socket such that the light source extends from the base housing.

46. The remote sound monitor of claim 45, wherein the light source is a light bulb.

47. The remote sound monitor of claim 45, wherein the casing is attached to the base housing and encloses the light source.

48. The remote sound monitor of claim 45, wherein the sound transducer includes a microphone.

49. The remote sound monitor of claim 48, wherein the sound transducer further includes a processor that provides the parameter.

50. The remote sound monitor of claim 45, wherein the sound transducer is a digital sound transducer that provides a digital audio signal.

51. The remote sound monitor of claim 50, wherein the audio transmitter is a digital audio transmitter.

52. The remote sound monitor of claim 51, wherein the audio receiver is a digital audio receiver.

53. The remote sound monitor of claim 45, wherein the light source is recessed in the base housing.

54. The remote sound monitor of claim 53, wherein the light source is a light emitting diode.

55. The remote sound monitor of claim 53, wherein the casing is attached to the base housing over the recessed light source.

56. The remote sound monitor of claim 45, wherein the casing is transparent.

57. The remote sound monitor of claim 45, wherein the casing is translucent.

58. The remote sound monitor of claim 45, wherein the casing is an elongated hollow structure.

59. The remote sound monitor of claim 45, wherein the casing is fabricated from at least one material selected from the group consisting of acrylic, K-resin, crystal styrene, clarified ABS, and natural HDPE.

60. The remote sound monitor of claim 45, wherein the light source includes at least one of electro-luminescent material and thermo-luminescent material.

61. The receiver unit of claim 45, further comprising an audio speaker that converts the received audio signal to audible sound.

62. The receiver unit of claim 61, further comprising an audio amplification circuit that amplifies the received audio signal and provides the amplified audio signal to the audio speaker.

63. The receiver unit of claim 62, wherein the audio amplification circuit includes noise-reduction circuitry that increases a signal-to-noise ratio of the amplified audio signal.

64. The receiver unit of claim 62, wherein the audio amplification circuit includes a switch that selectably actuates and de-actuates the audio amplification circuit.

65. The receiver unit of claim 62, wherein the audio amplification circuit includes a gain selector that adjusts a gain of the audio amplification circuit.

66. The receiver unit of claim 65, wherein the gain selector includes a potentiometer.

* * * * *